US006038418A

United States Patent [19]

Chigono et al.

[11] Patent Number: 6,038,418

[45] Date of Patent: Mar. 14, 2000

[54] CHARGING METHOD AND A CHARGING DEVICE FOR CHARGING A MEMBER TO BE CHARGED BY A FLEXIBLE CHARGING MEMBER

[75] Inventors: Yasunori Chigono, Susono; Harumi Ishiyama; Jun Hirabayashi, both of Numazu, all of Japan

[73] Assignee: Canon Kabushiki Kaisha, Tokyo, Japan

[21] Appl. No.: 09/102,652

[22] Filed: Jun. 23, 1998

[30] Foreign Application Priority Data

Jun. 23, 1997 [JP] Japan ..... 9-181758
May 14, 1998 [JP] Japan ..... 10-150610

[51] Int. Cl.[7] ..... G03G 15/02

[52] U.S. Cl. ..... 399/174; 361/225; 399/175; 399/176

[58] Field of Search ..... 399/168, 174–176; 361/225, 229, 230

[56] References Cited

U.S. PATENT DOCUMENTS 5,457,522 10/1995 Haneda et al. ..... 399/176
5,592,264 1/1997 Shigeta et al. ..... 399/175

FOREIGN PATENT DOCUMENTS 63-149669 6/1988 Japan .
5-150539 6/1993 Japan .
6-3921 1/1994 Japan .
7-7994 1/1995 Japan .

*Primary Examiner*—William J. Royer
*Attorney, Agent, or Firm*—Fitzpatrick, Cella, Harper & Scinto

[57] ABSTRACT

A charging device includes a charging member to which a voltage is applicable to charge a member to be charged; an electroconductive particle supply member for supplying electroconductive particles, wherein the supply member produces the electroconductive particles by abrasion of itself, and the thus produced electroconductive particles are fed to the nip formed by the charging member and the member to be charged.

29 Claims, 5 Drawing Sheets

CHARGING METHOD AND A CHARGING DEVICE FOR CHARGING A MEMBER TO BE CHARGED BY A FLEXIBLE CHARGING MEMBER

FIELD OF THE INVENTION AND RELATED ART

The present invention relates to a charging device for charging a member to be charged or a member to be charged and an image forming apparatus provided with the charging device. Suitable examples of the image forming apparatus includes an electrophotographic copying machine, an electrophotographic printer or the like. The present invention further relates to a charging method and a charging device for charging a surface of the member to be charged by a flexible charging member forming a nip with the member to be charged.

Heretofore, a corona type charger (corona discharging device) has been widely used as a charging apparatus for charging (inclusive of discharging) an image bearing member (member to be charged) such as an ealectrophotographic photosensitive member or an (electrostatic dielectric recording member to a predetermined polarity and a predetermined potential level in an image forming apparatus, for example, an electrophotographic apparatus or an electrostatic recording apparatus.

The corona type charging device is a non-contact type charging device, and comprises a corona discharging electrode such as a wire electrode, and a shield electrode which surrounds the corona discharging electrode. It is disposed so that a corona discharging opening thereof faces an image bearing member, that is, a member to be charged. In usage, the surface of an image bearing member is charged to a predetermined potential level by being exposed to a discharge current (corona shower) generated as high voltage is applied between the corona discharging electrode and the shield electrode.

Recently, it has been proposed to employ a contact type charging apparatus as a charging apparatus for charging the image bearing member, that is, the member to be charged, in an image forming apparatus of low to medium speed. This is due to the fact that contact type charging apparatus has an advantage over a corona type charging apparatus in terms of low ozone production, low power consumption, or the like. Also, such a contact type charging apparatus has been put to practical use.

In order to charge a member such as an image bearing member with the use of a contact type charging apparatus, the electrically conductive charging member (contact type charging member, contact type charging device, or the like) of a contact type apparatus is placed in contact with the member to be charged, and an electrical bias (charge bias) of a predetermined level is applied to this contact type charging member so that surface of the member to be charged is charged to a predetermined polarity and a predetermined potential level. The charging member is available in various forms, for example, a roller type (charge roller), a fur brush type, a magnetic brush type, a blade type, and the like.

When a member is electrically charged by a contact type charging member, two types of charging mechanisms (charging mechanism or charging principle.):

(1) mechanism which discharges electrical charge, and (2) mechanism for injecting charge, come into action.

Thus, the characteristics of each of contact type charging apparatuses or methods are determined by the charging mechanism which is the dominant one of the two in charging the member.

(1) Electrical Discharge Based Charging Type or Mechanism

In this charging mechanism, the surface of a member to be charged is charged by electrical discharge which occurs across a microscopic gap between a contact type charging member and the member to be charged.

In the case of the electrical discharge based charging mechanism, there is a threshold voltage which must be surpassed by the charge bias applied to a contact type charging member before electrical discharge occurs between a contact type charging member and a member to be charged, and therefore, in order for the member to be charged through the electrical discharge based charging mechanism, it is necessary to apply to the contact type charging member a voltage with a value greater than the value of the potential level to which the member is to be charged. Thus, in principle, when the electrical discharge based charging mechanism is in action, the discharge product is unavoidable, that is, active ions such as ozone ions are produced, even though the amount thereof is remarkably small.

(2) Direct Charge Injection Type or Mechanism

This is a mechanism in which the surface of a member to be charged is charged by electrical charge directly injecting into the member to be charged, with the use of a contact type charging member. Thus, this mechanism is called "direct charging mechanism", or "charge injection mechanism".

More specifically, a contact type charging member with medium electrical resistance is placed in contact with the surface of a member to be charged to directly inject electrical charge into the surface portion of the member to be charged, without relying on electrical discharge, in other words, without using electrical discharge in principle. Therefore, even if the value of the voltage applied to a contact type charging member is below the discharge starting voltage value, the member to be charged can be charged to a voltage level which is substantially the same as the level of the voltage applied to the contact type charging member. This direct injection charging mechanism does not suffer from the problems caused by the by-product of electrical discharge since it is not accompanied by ozone production.

However, in the case of this charging mechanism, the state of the contact between a contact type charging member and a member to be charged greatly affects the manner in which the member is charged, since this charging mechanism is such a mechanism that directly charges a member. Thus, this direct injection charging mechanism should comprise a contact type charging member composed of high density material, and also should be given a structure which provides a large speed difference between the charging member and the member to be charged, so that a given point on the surface of the member to be charged makes contact with a larger area of the charging member.

A) Charging Apparatus with Charge Roller

In the case of a contact type charging appartus, a roller charge system, that is, a charging system which employs an electrically conductive roller (charge roller) as a contact type charging member, is widely used because of its desirability in terms of safety.

As for the charging mechanism in this roller charge system, the aforementioned (1) charging mechanism, which discharges electrical charge, is dominant.

Charge rollers are formed of rubber or foamed material with substantial electrical conductivity, or electrical resistance of a medium level. In some charge rollers, the rubber or foamed material is layered to obtain a specific characteristic.

In order to maintain stable contact between a charge roller and a member to be charged (hereinafter, "photosensitive member"), a charge roller is given elasticity, which in turn increases frictional resistance between the charge roller and the photosensitive member. Also in many cases, a charge roller is rotated by the rotation of a photosensitive drum, or is individually driven at a speed slightly different from that of the photosensitive drum. As a result, problems occur: absolute charging performance declines, the state of the contact between the charge roller and the photosensitive drum becomes less desirable, and foreign matter adheres to the charge roller and/or the photosensitive member. With a conventional charging roller, the dominant charging mechanism through which a roller charging member charged a member to be charged was a corona charging mechanism.

FIG. 7 is a graph which shows an example of efficiency in contact type charging. In the graph, the abscissas represents the bias applied to a contact type charging member, and the axis of ordinate represents the potential levels correspondent to the voltage values of the bias applied to the contact type charging member.

The characteristics of the conventional charging by a roller are represented by a line designated by a character A. According to this line, when a charge roller is used to charge a member, the charging of the member occurs in a voltage range above an electric discharge threshold value of approximately −500 V. Therefore, generally, in order to charge a member to a potential level of −500 V with the use of a charge roller, either a DC voltage of −1,000 V is applied to the charge roller, or an AC voltage with a peak-to-peak voltage of 1,200 V, in addition to a DC voltage of −500 V, is applied to the charge roller to keep the difference in potential level between the charge roller and the member to be charged, at a value greater than the electric discharge threshold value, so that the potential of the photosensitive drum converges to the desired potential level.

More specifically, in order to charge a photosensitive drum with a 25 microns thick organic photoconductor layer by pressing a charge roller upon the photosensitive member, charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage V[−]th[−].

In other words, in order to charge the surface of a photosensitive member to a potential level of V[−]d[−] which is necessary for electrophotography, a DC voltage of (V[−]d[−]+V[−]th[−]th[−], which is higher than the voltage level to which the photosensitive member is to be charged, is necessary. Hereinafter, the above described charging method in which only DC voltage is applied to a contact type charging member to charge a member will be called "DC charging method".

However, with the use of the DC charging method, it was difficult to bring the potential level of a photosensitive member exactly to a target level, since the resistance value of a contact charging member changed due to changes in ambience or the like, and also the threshold voltage V[−]th[−] changed as the photosensitive member was shaved away.

As for a counter measure for the above described problem, Japanese Laid-Open Patent Application No. 149, 669/1988 discloses an invention which deals with the above problem to effect more uniform charging of a photosensitive member. According to this invention, an "AC charging method" is employed, in which a compound voltage composed of a DC component equivalent to a desired potential level V[−]d[−], and an AC component with a peak-to-peak voltage which is twice the threshold voltage V[−]th[−], is applied to a contact type charging member. This is intended to utilize the averaging effect of alternating current. That is, the potential of a member to be charged is caused to converge to the v[−]d[−], that is, the center of the peaks of the AC voltage, without being affected by external factors such as operational ambience.

However, even in such a case of the contact type charging apparatus, the principal charging mechanism is a charging mechanism which uses electrical discharge from a contact type charging member to a photosensitive member. Therefore, as already described, the voltage applied to the contact type charging member needs to have a voltage level higher than the voltage level to which the photosensitive member is to be charged. Thus, ozone is generated, although only in a small amount.

Further, when AC current is used so that a member is uniformly charged due to the averaging effect of AC current, the problems related to AC voltage become more conspicuous. For example, more ozone is generated; noises traceable to the vibration of the contact type charging member and the photosensitive drum caused by the electric field of AC voltage increase; the deterioration of the photosensitive member surface caused by electrical discharge increases, which add to the prior problems.

B) Charging Apparatus with Fur Brush

In the case of this charging apparatus, a charging member (fur brush type charging device) with a brush portion composed of electrically conductive fiber is employed as the contact type charging member. The brush portion composed of electrically conductive fiber is placed in contact with a photosensitive member as a member to be charged, and a predetermined charge bias is applied to the charging member to charge the peripheral surface of the photosensitive member to a predetermined polarity and a predetermined potential level.

Also in the case of this charging apparatus with a fur brush, the dominant charging mechanism is the electrical discharge based charging mechanism.

It is known that there are two type of fur brush type charging devices: a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/mm[+]2[+] can be relatively easily obtained, but the density of 100 fiber/mm[+]2[+] is not sufficient to create a state of contact which is satisfactory to charge a member by charge injection. Further, in order to give a photosensitive member satisfactorily uniform charge by charge injection, velocity difference which is almost impossible to attain with the use of a mechanical structure must be established between a photosensitive drum and a roller type fur brush. Therefore, the fur brush type charging device is not practical.

The relationship between the DC voltage applied to a fur brush type charging member and the potential level to which a photosensitive member is charged by the DC voltage applied to the fur brush shows a characteristic represented by a line B in FIG. 7. As is evident from the graph, also in the case of the contact type charging apparatus which comprises a fur brush, whether the fur brush is of the fixed type or the roller type, the photosensitive member is charged mainly through electrical discharge triggered by applying to the fur brush a charge bias the voltage level of which is higher than the potential level desired for the photosensitive member.

C) Magnetic Brush Type Charging Apparatus

A charging apparatus of this type comprises a magnetic brush portion (magnetic brush based charging device) as the contact type charging member. A magnetic brush is constituted of electrically conductive magnetic particles magnetically confined in the form of a brush by a magnetic roller or the like. This magnetic brush portion is placed in contact with a photosensitive member as a member to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism (2).

As for the material for the magnetic brush portion, electrically conductive magnetic particles, the diameters of which are in a range of 5–50 microns, are used. With the provision of sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact type charging member, as shown by a line C in FIG. 9.

However, a magnetic brush type charging apparatus also has its own problems. For example, it is complicated in structure. Also, the electrically conductive magnetic particles which constitute the magnetic brush portion become separated from the magnetic brush and adhere to a photosensitive member.

Japanese Patent Publication Application No. 3,921/1994 discloses a contact type charging method, according to which a photosensitive member is charged by injecting electric charge into the charge injectable surface layer thereof, more specifically, into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise traceable to the application of AC voltage. In other words, a magnetic brush type charging system is an excellent charging system superior to the roller type charging system in terms of ozone generation and power consumption, since it does not generate ozone, and uses far less power compared to the roller type charging system.

D) Toner Recycling Process (Cleanerless System)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection, it is desirable that waste toner is not produced. Thus, image forming apparatuses capable of recycling toner have been developed. In such an image forming apparatus, a cleaner is eliminated, and the toner which remains on the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference V[−]back[−] between the level of the DC voltage applied to a developing apparatus and the level of the surface potential of a photosensitive member) during the following image transfer. According to this cleaning method, the residual toner is recovered by the developing apparatus and is used for the following image development and thereafter; the waste toner is eliminated. Therefore, the labor spent for maintenance is reduced. Further, being cleanerless is quite advantageous in terms of space, allowing image forming apparatuses to be substantially reduced in size.

In a toner recycling system, the untransferred toner is not removed from photosensitive member surface by a cleaner provided exclusively therefor, but is fed to the developing device passing by the charging means portion, and then is reused for the development process again, and therefore, in the case that contact charging is used as the charging means for the photosensitive member, the toner which is insulative exists in the contact portion between the contact charging member and the photosensitive member. In this case, there arises a problem of how to charge the photosensitive member. In the above-described roller charging or brush charging, the uantransferred toner is scattered into non-pattern distribution on the photosensitive member, and a high bias voltage is applied to effect charging with the use of electric discharge in many cases. In the magnetic brush charging, powder is used as the contact charging member, and therefore, the magnetic brush portion of the electroconductive magnetic particle (powder) is softly contacted to the photosensitive member to charge the photosensitive member, but the equipment structure is complicated, and the problem attributable to the drop of the electroconductive magnetic particle constituting the magnetic brush portion is significant.

E) Coating of Contact Type Charging Member with Electrically Conductive Powder

Japanese Patent Application Publication No. 7994/1995 discloses a contact type charging apparatus with such a structure that coats a contact type charging member with electrically conductive powder, on the surface which comes in contact with the surface of a member to be charged, so that surface of the member to be charged is uniformly charged, that is, without irregularity in charge. The contact type charging member in this charging apparatus is rotated by the rotation of the member to be charged, and the amount of ozone generated by this charging apparatus is remarkably small compared to the amount of ozonic products generated by a corona type charging apparatus such as scorotron. However, even in the case of this charging apparatus, the principle, based on which a member is charged, is the same as the principle, based on which a member is charged by the aforementioned charge roller; in other words, a member is charged by electrical discharge.

Further, also in the case of this charging apparatus, in order to assure that the member to be charged is uniformly charged, a compound voltage composed of a DC component and an AC component is applied to the contact type charging member, and therefore, the amount of ozonic products traceable to electrical discharge becomes relatively large. Thus, even this contact type charging apparatus is liable to cause problems; for example, images are affected by ozonic products, appearing as if flowing, when this charging apparatus is used for an extended period of time, in particular, when this charging apparatus is used in a cleanerless image forming apparatus for an extended period of time.

Japanese Laid-open Patent Application No. HEI-5-150539 discloses an image forming method using a contact charging wherein in order to avoid the charging problem due to deposition of the fine silica particles or toner particles during repeated long term image formation on the surface of the charging means, the developer contains at least visualizing particles and electroconductive particles having an average particle size smaller than that of the visualizing particles. However, the contact charging is based on the discharge-charging mechanism rather than the direct injection charging mechanism, and therefore, involves the above-described problems attributable to the discharging.

As described in the preceding paragraphs regarding the technologies prior to the present invention, it is difficult to effect the direct charging with the use of a contact type charging apparatus with a simple structure which comprises a contact type charging member such as a charge roller or a fur brush, since sufficiently close contact between the charging member and the member to be charged is not assured because of the roughness of the surface of the contact charging member.

The contact charging member tends to pick foreign matter up from the surface of the member to be charged, and therefore, is easily contaminated; if the deposited contamination is insulative, then improper charging would result.

In view of this, in the contact charging, even if a simple member such as a charging roller, fur brush or the like is used as the contact charging member, a simple structure for ozoneless injection charging with low applied voltage is desired in which stabilized direct charging is accomplished with high uniform charging property for long term despite the contamination of the contact charging member.

When a contact charging device is employed in an image recording device to charge the image bearing member, it is very advantageous in the structure simplification and the performance if the ozoneless injection charging is accomplished with low voltage application, using a simple charging roller or fur brush as the contact charging member.

As regards the contamination of the contact charging member used in a transfer type image recording device employing it as the contact charging device for the charging means, it is difficult to completely remove the untransferred toner from the image bearing member by a cleaner which is provided exclusively for removing the untransferred toner from the image bearing member after the developer image (toner image) formed and carried on the image bearing member and then transferred onto a recording material. A small amount of the toner passing the cleaner is carried to the charge portion where the contact charging member and the image bearing member are contacted to each other, by the movement of the image bearing surface, and is deposited and accumulated on the contact charging member, so that the contact charging member is gradually contaminated with the toner.

Since the conventional toner is insulative, existence of the toner in the charge portion which is a contact portion between the image bearing member and the contact charging member or the contamination of the contact charging member with toner, are charge blocking factors which would result in the improper charging.

Particularly in an image recording device of toner recycling system(cleanerless), no addicted cleaner is employed to remove the untransferred toner from the image bearing surface after the image transfer, and therefore, the untransferred toner on the image bearing surface remaining after the image transfer, is carried to the charge portion which is a contact portion between the contact charging member and the image bearing member by the movement of the image bearing surface, with the result that the contact charging member is remarkably contaminated with toner.

SUMMARY OF THE INVENTION

Accordingly, it is a principal object of the present invention to provide a charging device and an image forming apparatus wherein the charging uniformity is good irrespective of toner contamination of the charging member. It is another object of the present invention to provide a charging device and an image forming apparatus wherein the voltage applied to the charging member can be decreased, and therefore, the generation is suppressed. It is a further object of the present invention to provide a charging device and an image forming apparatus wherein a charging member can be used stably for a long term even when it is used in a toner recycling system.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
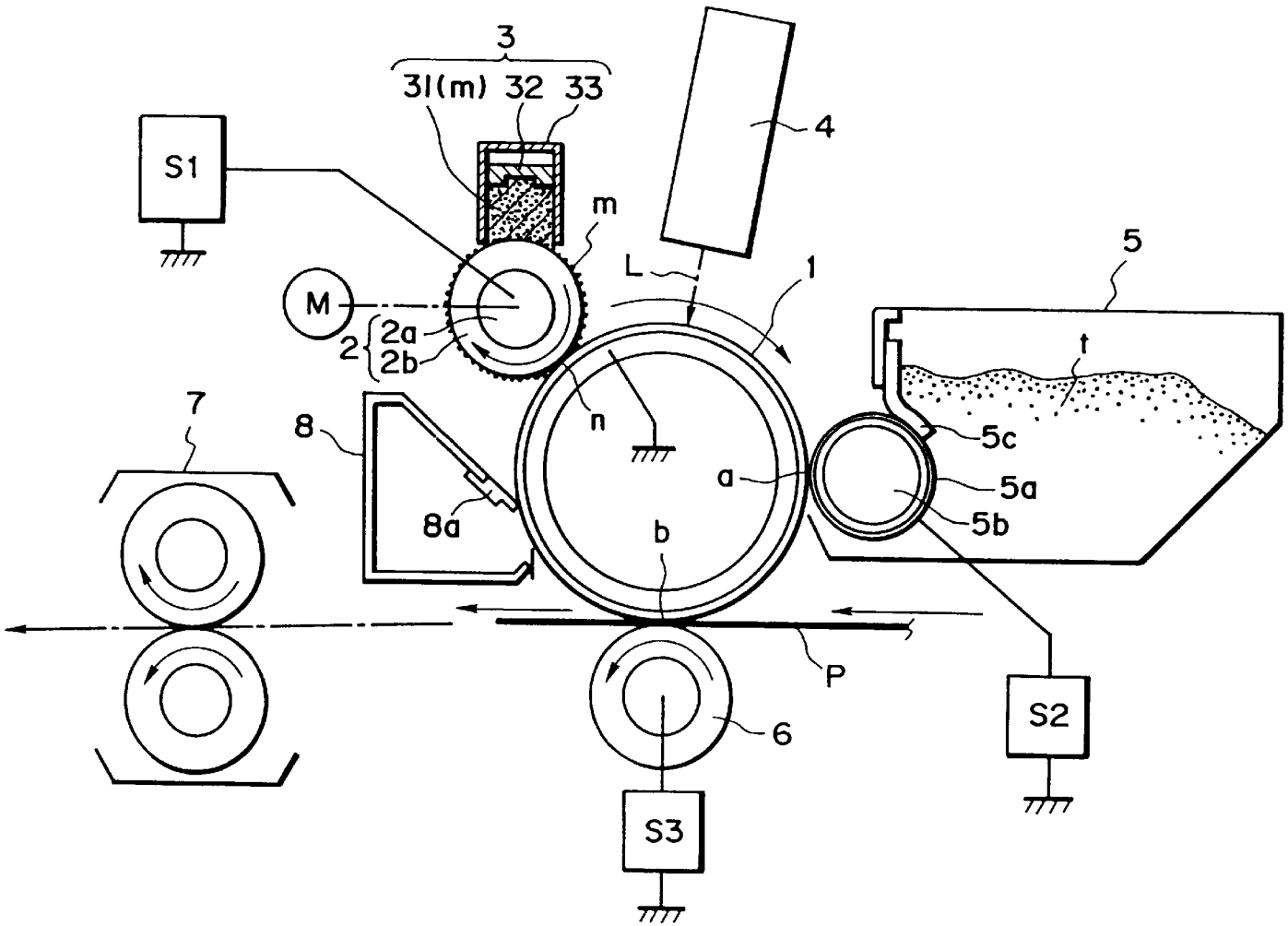
FIG. 1 is a schematic illustration of an image recording device according to Embodiment 1.

Embodiment 1 (FIG. 1)

FIG. 1 is a schematic view of an example of an image recording device according to an embodiment of the present invention.

The image recording device of this embodiment is in the form of a laser beam printer of a contact charging type using a transfer type electrophotographic process.

(1) Schematic General Arrangement of Printer

Designated by 1 is an image bearing member which is a negative OpC photosensitive member of rotatable drum type having a diameter of ϕ30 mm in this embodiment. The photosensitive drum 1 is rotated at a constant speed more particularly at a peripheral speed of 50 mm/sec (=process speed PS or printing speed) in the clockwise direction arrow.

Designated by 2 is an electroconductive elastic roller (charging roller) as a contact charging member which is contacted to the photosensitive drum 1 with a predetermined pressure.

Designated by n is a charging nip formed between the photosensitive drum 1 and the charging roller 2.

Designated by 3 is a charge promotion particle supplying means for the charging roller 2, and supplies and applies charge promotion particles m to the outer surface of the charging roller 2 so that charge promotion particles m are present in the charging nip n formed between the photosensitive drum 1 and the charging roller.

The charging roller 2 is rotated in a direction opposite from the peripheral movement direction of the photosensitive drum 1 in the charging nip n so that it is contacted to the surface of the photosensitive drum 1 with a speed difference. Designated by M is a driving source for the charging roller 2.

The charging roller 2 is supplied with a predetermined charging bias(a DC voltage of −700 v in this example) from the charging bias applying voltage source S1.

By doing so, the peripheral surface of the rotatable photosensitive drum 1 is uniformly charged to substantially the same potential as the level of the application charging bias to the charging roller 2 through a direct charging (injection charging) system.

The charging roller 2, charge promotion particle supplying means 3 and the direct charging action and the like will be described hereinafter.

Designated by 4 is a laser beam scanner (exposure device) including a laser diode and a polygonal mirror. The laser beam scanner 4 emits a laser beam subjected to intensity modulation corresponding to time series electrical digital pixel signals of an intended image information, and the laser beam is projected onto the uniformly charged (surface of the rotatable photosensitive drum 1 (scanning exposure L).

By the scanning exposure L, an electrostatic latent image is formed correspondingly to the intended image information on the surface of the rotatable photosensitive drum 1.

Designated by 5 is a developing device. The electrostatic latent image on the surface of the rotatable photosensitive drum 1 is developed into a toner image at the developing portion a by the developing device 5.

In this embodiment, the developing device 5 is a reverse development device using an one-component magnetic toner(negative charged toner) as a developer t. Designated by 5*a* is a non-magnetic rotatable developing sleeve as a developer carrying member containing therein a magnet roller 5*b*, and the toner t as the developer in the developing device 5 is subjected to layer thickness regulation action of a regulation blade 5*c* and electric charge application during the toner being carried on the rotatable developing sleeve 5*a*.

The developer on the rotatable developing sleeve 5*a* is carried to a developing zone a where the sleeve 5*a* is opposed to the photosensitive drum 1, by rotation of the sleeve 5*a*. The sleeve 5*a* is supplied with a developing bias voltage from a developing bias applying voltage source S2.

In the embodiment, the developing bias voltage contains the following superimposed:

DC voltage: −500V:

AC voltage: peak-to-peak voltage of 1600v, and peak-to-peak voltage of voltage (rectangular wave)

The electrostatic latent image on the photosensitive drum 1 is reverse-developed with the developer t by this.

The one component magnetic toner t which is a developer produced by mixing binder resin, magnetic particles and charge control material and kneading, pulverization and classifying them into toner powder. Fluidizing material or the like is added to the powder. The weight average particle size (D4) of the toner was 7 $\mu$m.

Designated by 6 is a transfer roller having an intermediate resistance and functioning as a contact type transferring means, and it is press-contacted to the photosensitive drum 1 at a predetermined pressure to form a transfer nip b. A transfer material P as a recording material is fed to the transfer nip b at a predetermined timing from an unshown sheet feeder, and a predetermined transfer bias voltage is applied to the transfer roller 6 from the transfer bias application voltage source S3 so that the toner image is sequentially transferred from the photosensitive drum 1 onto the surface of the transfer material P.

The transfer roller 6 used in this embodiment comprises a metal core and an intermediate resistance foam layer thereon and has a roller resistance value of $5\times10^8\Omega$. The metal core was supplied with a voltage of +2.0 kV to effect the image transfer. The transfer material P introduced to the transfer nip b is nipped and fed by the transfer nip b, during which the toner image is transferred from the rotatable photosensitive drum 1 onto the front side thereof by the electrostatic force and the pressure.

Designated by 7 is a fixing device of a heat fixing type or the like. The transfer material P now having the thus transferred toner image is separated from the surface of the rotatable photosensitive drum 1 and is fed to the fixing device 7, where the toner image is fixed, and is discharged out as a print (print or copy).

Designated by 8 is a cleaner (cleaning device) for the photosensitive drum. The untransferred toner on the surface of the drum after toner image transfer to the transfer material P, is scraped off by the cleaning member 8*a* of the cleaner 8 (cleaning blade (elastic blade) contacted to the surface of the photosensitive drum 1 in this example) to be prepared for the repeated image formation. The untransferred toner removed from the surface of the photosensitive drum 1 by the cleaning blade 8*a*, is accumulated in a cleaner container as residual toner.

(2) Charging Roller 2

The charging roller 2 as a flexible contact charging member, is produced by forming, on a metal core 2*a*, an intermediate resistance layer 2*b* (flexible member) of rubber or foam material.

The intermediate resistance layer 2*b* comprises resin material (e.g. Urethane), electroconductive particles (e.g. Carbon black), sulfurizing material, foaming material or the like is formed on the metal core 2*a* of the roller. Thereafter, the surface was abraded, upon necessity, to produce a charging roller 2 in the form of an electroconductive elastic roller having a length 200 mm and a diameter of 12 mm.

The roller resistance of the charging roller 2 in this embodiment was 100 k$\Omega$. The roller resistance was measured as follows. The charging roller 2 was press-contacted to an aluminum drum having a diameter of 30 mm which was the same as the diameter of the photosensitive drum such that total pressure 1 kg was applied to the metal core 2*a* of the charging roller 2, and 100 v was applied between the metal core 2*a* and the aluminum drum.

It is important that charging roller 2 which is a contact charging member functions as an electrode. Namely, it is given the elasticity to provide sufficient contact state to the member to be charged, and simultaneously, it has a sufficiently low resistance to charge the moving member to be charged. On the other hand, in view of the case that the member to be charged has a low withstand level portion such as a pin hole, the leakage has to be prevented. When use is made with the photosensitive member for electrophotography as the member to be charged, the resistance of $10^4$–$10^7\Omega$ is desirable from the standpoint of providing sufficient charging property and anti-leakage.

The surface of the charging roller 2 is desirably provided with micromatic unsmoothnesss to hold the charge promotion particles m. That is, the roller 2 is preferably an foam member.

If the hardness of the charging roller 2 is too low, the configuration is not stabilized with the result that the contact property with the member to be charged is poor, and if it is too high, no sufficient charging nip n is assured between the member to be charged and itself, and also, the microscopic contact property to the surface of the member to be charged is poor, and therefore, the hardness is preferably 25° to 50° in Asker C hardness.

The material of the charging roller 2 is not limited to the elastic foam, but other examples of the elastic roller include rubber material or rubber foam such as EPDM, urethane, NBR, silicone rubber, IR or the like in which an electroconductive substance such as carbon black, metal oxide or the like is dispersed for resistance adjustment. It is possible to adjust the resistance using the ion electroconductive material without dispersing the electroconductive substance.

The charging roller 2 is press-contacted to the photosensitive drum 1 as the member to be charged with a predetermined pressure against the elasticity to form a charging nip n having a width of several mm in this embodiment.

In this embodiment, the charging roller 2 is rotated in the clockwise direction indicated by the arrow at approximately 80 rpm so that the charging roller surface and the photosensitive drum surface move in the charging nip n at the same speed in the opposite directions. Thus, there is a speed difference between the surface of the charging roller 2 as the contact charging member and the surface of the photosensitive drum 1.

The metal core 2*a* of the charging roller 2 is supplied with a DC voltage of −700V as the charging bias from the voltage source S1.

(3) Charge Promotion Particle Supplying Means

In this embodiment, the charge promotion particle supplying means 3 comprises a charge promotion particle supply member 31, a supporting member 32 for the charge promotion particle supply member, a housing 33 accommodating the charge promotion particle supply member, and is disposed above the charging roller 2, wherein the lower surface of the charge promotion particle supply member 31 in the housing 33 is normally contacted to the upper surface of the charging roller 2 by the weight of the charge promotion particle supply member 31 and the supporting member 32 therefor.

The charge promotion particle supply member 31 is in the form of solid bar made of bound and solidified charge promotion particles m (charge promotion particle bar), and they are abraded by the rotating charging roller 2, like chalk or agalmatolite, by which the charge promotion particles m are applied to the surface of the charging roller 2.

For example, the bar comprises charge promotion particles m such as zinc oxide particles, alumina particles or the like bound by the binder resin material with solvent. More particularly, styrene acrylic resin material as the binder resin material is solved in ethanol with the content of 5 wt %, and 7 times by weight, on the basis of the binder resin material, of the charge promotion particles m of zinc oxide particles or the like are mixed therein. The liquid is supplied into a mold and dried to bind and solidify the charge promotion particles m into the charge promotion particle supplying material in the form of bar.

In this embodiment, the charge promotion particles m are alumina powder having the resistivity of $10^6\Omega$cm and an average particle size of 3 $\mu$m.

The material of the charge promotion particles m may be electroconductive inorganic particles of metal oxide or a mixture thereof with organic material, which may be subjected to the surface treatment.

The specific resistance of the particles m is desired to be no more than 10[+]12[+] Ohm.cm, preferably, no more than 10[+]10[+] Ohm.cm, since electrical charge is given or received therethrough.

The specific resistance of the charge promotion particles m is obtained using a tablet method. That is, first, a cylinder which measures 2.26 cm[+]2[+] in bottom area size is prepared. Then, 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

The particle size is desirably not more than 50 $\mu$m for the satisfactory uniform charging. The particle size of coagulated material of the particles is defined as an average particle size of the coagulated materials. As for the method of measuring the particle size, more than 100 particles are extracted using an optical or electron microscope, and the volume particle size distribution is calculated on the basis of a maximum arc distance in the horizontal direction, and the particle size is defined as the 50% average particle size.

The charge promotion particles m may be in the form of primary particles or secondary particles. The state of coagulations is not material if they function to promote the charging, but the particle density is of importance.

The charge promotion particles are non-color or white particles from the standpoint of avoiding disturbance to the latent image exposure when it is used for charging the photosensitive member.

The charge promotion particles are preferably white in color or close to transparent to avoid disturbance to the exposure, and is preferably of non-magnetic material.

Since a part of the charge promotion particles are unavoidably transferred onto the transfer material from the photosensitive member, it is desirably white of non-color in the case of color recording. From the standpoint of preventing the light scattering by the particles during the image exposure, the particle size is desirably not more than the constituent pixel size. The lower limit of the particle size is 10 nm from the standpoint of stabilized production thereof.

(4) Direct Charging

Since the charge promotion particles m are supplied and applied to the charging roller 2 by the charge promotion particle supply member bar 31 supplied from the charge promotion particle supplying means 3, the contact charging for the photosensitive drum 1 is carried out with the charge promotion particles m present in the charging nip portion n between the charging roller 2 and the photosensitive drum 1. By the existence of the charge promotion particles m in the charging nip n between the charging roller 2 and the photosensitive drum 1, a charging roller which has a large friction resistance and which therefore is not easily contacted to the photosensitive drum 1 with speed difference, can be easily contacted thereto with the speed difference, because of the lubricant effect of the particles m, and simultaneously, the charging roller 2 is electrically close-contacted to the surface of the photosensitive drum 1 by the provision of the particles m, so that it is virtually contacted thereto at high frequency.

By the provision of the speed difference between the photosensitive drum 1 and the charging roller 2, the chances of contacts between the charge promotion particles m and the photosensitive drum 1 in the nip between the photosensitive drum 1 and the charging roller 2 are increased remarkably, so that contact between the photosensitive drum and the charging roller is improved. The charge promotion particles m present in the nip between the photosensitive drum 1 and the charging roller 2 rub the surface of the photosensitive drum 1 without non-contact portion, so that charge is directly injected into the photosensitive drum 1, and in such a contact charging of the photosensitive drum 1 by the charging roller 2, the direct charging(injection charging) is dominant by the presence of the charge promotion particles.

In the image recording device(or printer) of this embodiment, the cleaner 8 is used to remove the untransferred toner from the surface of the photosensitive drum 1 after the image transfer, but it is difficult to completely remove the untransferred toner from the surface of the photosensitive drum 1, and particularly in the case of the cleaning using the elastic blade employed in the embodiment, fine particles having a small size pass under the blade 8*a*, and the blade is not turned over. Therefore, even in the image recording device provided with the cleaner 8, a small amount of the toner(insulative substance) particles which are a charge blocking factor is carried into the charging nip n, and is present in the nip or contaminates the charging roller 2.

Even in such a case, the existence of the charge promotion particles m in the charging nip n between the charging roller 2 and the photosensitive drum 1 is effective to prevent the contamination of the charging roller 2, and therefore, the contact property decrease due to the toner is compensated for, thus maintaining the close-contactness and the contact resistance between the charging roller 2 and the photosensitive drum 1, so that ozoneless direct charging with low applied voltage can be stably maintained with uniform charging property.

With the use of the apparatus, the charge promotion particles m may drop from the charging nip n between the charging roller 2 and the photosensitive drum 1. However, by the provision of the supply member 31 for supplying the charge promotion particles m to the charging roller 2, the charge promotion particles m are supplemented, so that reduction of the charging property due to the drop-out or decrease of the charge promotion particles m from the charging nip n, is prevented, thus maintaining the stabilized direct charging property for long term.

Since the supply of the charge promotion particles m to the charging roller 2 is effected by abrasion of the charge promotion particle supply member 31 themselves which are in the form of a bar of solidified charge promotion particles m, they can be easily supplied to the charging roller 2 without scattering and with stability.

Thus, a high charging efficiency is provided which is not provided in the conventional roller charging or the like of contact charging type, and the photosensitive drum 1 can be charged to the potential substantially equal to the voltage applied to the charging roller 2. Even when use is made of a simple and easy charging roller 2 as the contact charging member, the applied bias required by the charging roller 2 for the charging is not increased significantly by the contamination of the charging roller 2. Thus, there is provided a stable and safe direct contact charging device which does not use the discharge phenomenon (ozoneless) and which is operable with low applied voltage to provide high uniform charging for long term. In this example, the relation between the applied voltage to the charger and the drum surface potential is as shown in (C) of FIG. 7.

When it is used with an image recording device or an image recording device of the transfer type, the simple and easy charging roller 2 is usable which can effect the ozoneless direct charging with low applied voltage despite the toner contamination, and a high quality image formation can be maintained for a long term, and the high quality image formation is maintained for a long term even after images of height image ratio are processed.

If the amount of the charge promotion particles existing in the charging nip n between the charging roller 2 as the contact charging member and the photosensitive drum 1 as the image bearing member is too small, the lubricating effect is not sufficient with the result that friction between the photosensitive drum 1 and the charging roller 2 is too large, and therefore, it is difficult to rotate the charging roller 2 with speed difference relative to the photosensitive drum 1. In other words, the driving torque is too large, and if they are forced to rotate, the surface of the charging roller 2 and/or the photosensitive drum 1 may be scraped. Furthermore, the effect of contact chance increase by the particles, may not be provided with the result that the charging property is not sufficient. On the other hand, if the amount is too large, the drop-out of the charge promotion particles from the charging roller 2 is remarkably increased with the result of adverse influence to the image formation.

The experiments have revealed that the amount is desirably $10^3/mm^2$ or more. If it is smaller than $10^3/mm^2$, the lubricating effect and the contact chance increase effect are not sufficient with the result of the decrease of the charging property.

Further preferably, the amount is $10^3$–$5\times10^5/mm^2$. If it exceeds $5\times10^5/mm^2$, the drop-out of the particles onto the photosensitive drum 1 is remarkable, and the exposure amount shortage of the photosensitive drum 1 results irrespective of the light transmissivity of the particle. If it is $5\times10^5/m^2$ or smaller, the amount of the particles which drop out can be suppressed, thus avoiding the adverse influence. The amount of the dropped out particles on the photosensitive drum 1 was $10^2$–$10^5/mm^2$ within the above-described range of amount, and therefore, the desirable amount is $10^5/mm^2$ or less.

The method used for measuring the amount of the charge promotion particles m between the charging roller 2 and the photosensitive drum 1, and the amount of the charge promotion particles m on the photosensitive drum 1, will be described. It is desirable that amount of the charge promotion particles m between the charging roller 2 and the photosensitive drum 1 is directly measured in the charging nip n between the charging roller 2 and the photosensitive drum 1. However, most of the particles on the photosensitive drum 1 before the contact to the charging roller 2 are removed to the charging roller 2 while moving in the opposite direction, and therefore, the amount of the charge promotion particles on the charging roller 2 measured immediately before the charging nip n is substituted for the actual amount of the charge promotion particles between the charging roller 2 and the photosensitive drum 1. More specifically, the rotation of the photosensitive drum 1 and charging roller 2 is stopped, and the peripheral surfaces of the photosensitive drum 1 and the charging roller 2 are photographed by a video-microscope (product of Olympus: OVM1000N) and a digital still recorder (product of Deltis: SR-3100), without applying the charge bias. In photographing the peripheral surface of the charging roller 2, the charging roller 2 is pressed against a piece of slide glass under the same condition as the charging roller 2 is pressed against the photosensitive drum 1, and no less than 10 spots in the contact area between the charging roller 2 and the slide glass were photographed with the use of the video-microscope fitted with an object lens with a magnification power of 1,000. The thus obtained digital images are digitally processed using a predetermined threshold. Then, the number of cells in which a particle is present is counted with the use of a designated image processing software. As for the amount of the charge promotion particles on the photosensitive drum 1, the peripheral surface of the photosensitive drum 1 is photographed using the same video-microscope, and then, the obtained images are processed in the same manner to obtain the number of the charge promotion particles on the photosensitive drum 1. The amount of the particles is adjusted by setting the degree of application of the charge promotion particles to the charging roller 2 by the charge promotion particle bar 31.

Figure 2:
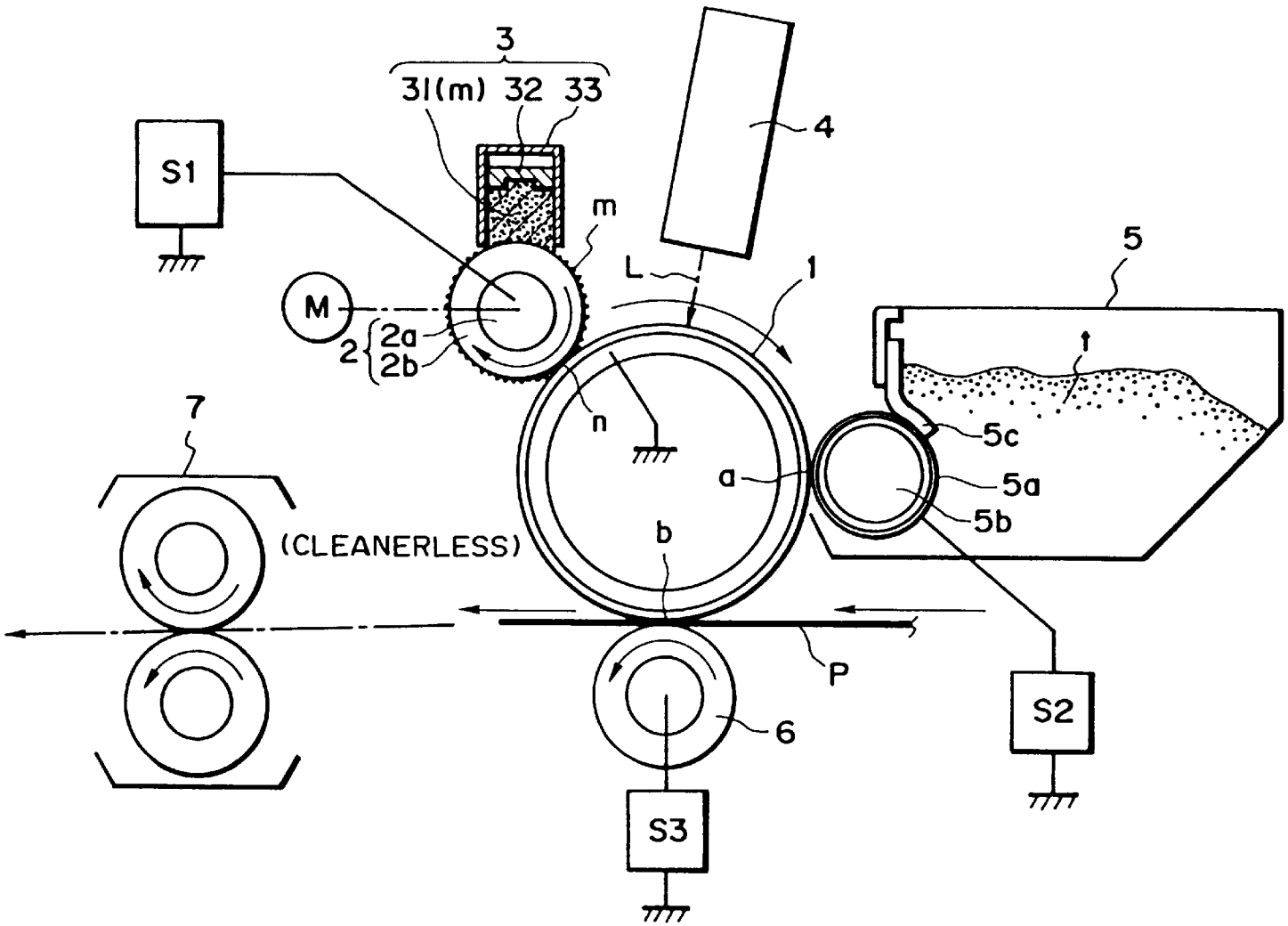
FIG. 2 is a schematic illustration of an image recording device according to Embodiment 2.

Embodiment 2 (FIG. 2)

The printer of this embodiment is similar to that of above-described Embodiment 1, but is not provided with the cleaner 8 (toner recycling system, or cleanerless system).

In this embodiment, the charge promotion particles m constituting the charge promotion particle bar 31 is electroconductive zinc oxide particle.

The structure of the printer of this embodiment is the same as that of the printer of Embodiment 1 in the other respects, and therefore, the detailed description thereof is omitted.

In the cleanerless image recording device, there is no cleaner exclusively for removing the untransferred toner from the photosensitive drum surface after the image transfer, and therefore, untransferred toner is carried to the charging nip n between the charging roller 2 and the photosensitive drum 1 by the movement of the photosensitive drum surface, and therefore, the toner amount in the charging nip n is larger than in the printer provided with the cleaner 8 of Embodiment 1, and the toner amount deposited and mixed into the charging roller 2 is also larger than that.

Even in such a case, however, the ozoneless direct charging can be effected with low applied voltage for a long term with stability, by the existence of the charge promotion particles m in the charging nip n between the photosensitive drum 1 and the charging roller 2 which is effective to prevent contamination of the charging roller 2 with the toner and to compensate for the contact property decrease, thus maintaining the proper close contact and proper contact resistance between the charging roller 2 and the photosensitive drum 1.

By the speed difference between the photosensitive drum 1 and the charging roller 2, the pattern of the untransferred toner arriving at the charging nip n from the transfer portion b is disturbed, and therefore, the ghost image which is a previous pattern appearing in the next image can be avoided, a halftone image.

The charging roller 2 is rotated to temporarily collect the untransferred toner and uniform it, and it is desirable to rotate it in a direction opposite from the movement direction of the photosensitive drum surface in the nip.

The supply pf the charge promotion particles m to the charging roller 2, similarly to Embodiment 1, is effected by the abrasion of the bar 31 which are solidified charge promotion particles. Therefore, the charge promotion particles m can be stably supplied to the charging roller 2 without scattering of the charge promotion particles. In the toner recycling system (cleanerless) as in this example, the untransferred toner is not accumulated on the charging roller 2 but is recirculated, and the charge promotion particles are supplied. In other words, the supply of the charge promotion particle m to the charging roller 2 and the toner uniformalization on the charging roller are simultaneously effected.

The mixed untransferred toner or the untransferred toner deposited on the charging roller 2, are gradually discharged to the photosensitive drum from the charging roller 2, and are carried to the developing portion a by the movement of the photosensitive drum surface, and removed (collected) simultaneously with the development by the developing device 5 (toner recycling).

The simultaneous development and cleaning for the residual or untransferred toner is effected in the subsequent image forming process. More particularly, in the development operation for the subsequent image after the charging and exposure of the photosensitive drum for the subsequent image, the untransferred toner is removed or collected by a fog removing bias in the developing device, more particularly, a fog removing potential difference Vback between the DC voltage applied to the developing device and the surface potential of the photosensitive drum. In the case of the reverse development as in the printer in this embodiment, the simultaneous development and cleaning is carried out by the electric field collecting the toner onto the developing sleeve from the dark potential portion of the photosensitive drum and the electric field depositing the toner onto the light potential portion of the photosensitive drum from the developing sleeve.

In this embodiment, the charge promotion particles m are of zinc oxide particles, and the zinc oxide particles as the charge promotion particles m, tend to charge the toner to the negative polarity due to the triboelectric charge property as compared with that of the toner. In other words, it is effective to charge the toner uniformly on the charging roller 2, thus improving the toner discharge.

By supply the charge promotion particles m while contacting the charge promotion particle bar 31 to the charging roller 2, the untransferred toner is smoothly circulated without stagnation, and simultaneously, the charge promotion particles can be supplied to the charging roller. Additionally, the toner on the charging roller can be triboelectrically charged to the regular polarity.

Figure 3:
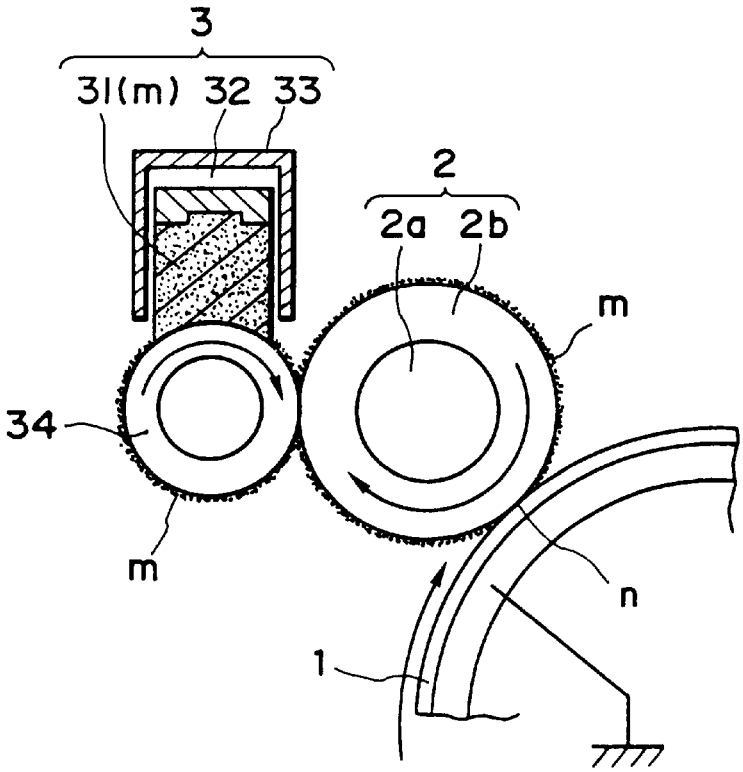
FIG. 3 is a schematic illustration of an image recording device according to Embodiment 3.

Embodiment 3(FIG. 3)

This embodiment is similar to above-described Embodiment 2 (cleanerless printer), but the charge promotion particle supplying means 3 for the charging roller 2 comprises charge promotion particle application roller(charge promotion particle applying member) 34 contacted to the charging roller 2, wherein the lower surface of charge promotion particle supply member(charge promotion particle bar) 31 are contacted to the upper side of the charge promotion particle application roller 34.

Designated by 32 is a supporting member for the charge promotion particle bar 31, and 33 is a housing for accommodating the charge promotion particle bar.

The lower surface of the charge promotion particle bar 31 in the housing 33 is normally contacted to the upper surface of the charge promotion particle application roller 34 by the weight of the bar an d the supporting member 32 therefor. The charge promotion particle application roller 34 is rotated in the clockwis e direction indicated by the arrow.

The charge promotion particle bar 31 is of charge promotion particles m which are bound and solidified, and is abraded by the rotating application roller 34 as a chalk or agalmatolite to be applied onto the surface of the application roller 34.

The other device structures are the same as the printer of Embodiment 2, and therefore, the disclosure thereof is omitted.

In this example, the charge promotion particles m are supplied and applied from the charge promotion particle bar 31 onto the charge promotion particle application roller 34, and are supplied and applied from the charge promotion particle application roller 34 to the charging roller 2.

In this structure, the charge promotion particles m are more uniformly supplied to the charging roller, and even if the distribution of the untransferred toner is not uniform, the charge promotion particles can be uniformly supplied by the use of the charge promotion particle application roller 34, and therefore, the charging property is stabilized.

COMPARISON EXAMPLE 1

The printer of this comparison example is a printer which is similar to that of Embodiment 1 but without the charge promotion particle supplying means 3 for the charging roller 2.

The other structures are the same as the printer of Embodiment 1.

COMPARISON EXAMPLE 2

The printer of this comparison example is a printer which is similar to the cleanerless printer of Embodiment 2 but without the charge promotion particle supplying means 3 for the charging roller 2.

The other structures are the same as the printer of Embodiment 2.

COMPARISON EXAMPLE 3

(FIG. 4)

Figure 4:
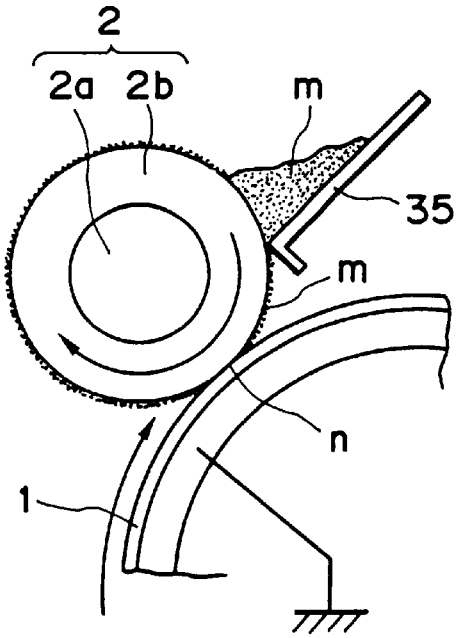
FIG. 4 is a schematic illustration of an image recording device of comparison example 3.

The printer of this comparison example is a printer which is similar to the cleanerless printer of Embodiment 2, but the charge promotion particle supplying means 3 for the charging roller 2 is different and is as shown in FIG. 4.

More particularly, in order to uniformly supply the charge promotion particles m onto the charging roller 2, a charge promotion particle application blade 35 is provided, and the blade 35 is contacted to the charging roller 2, wherein powdery charge promotion particles m are retained between the blade 35 and the charging roller 2. With the rotation of the charging roller 2, an amount of the charge promotion particles m regulated by the blade 35 is applied on the charging roller 2.

The other structures are the same as the printer of Embodiment 2.

COMPARISON EXAMPLE 4

Figure 5:
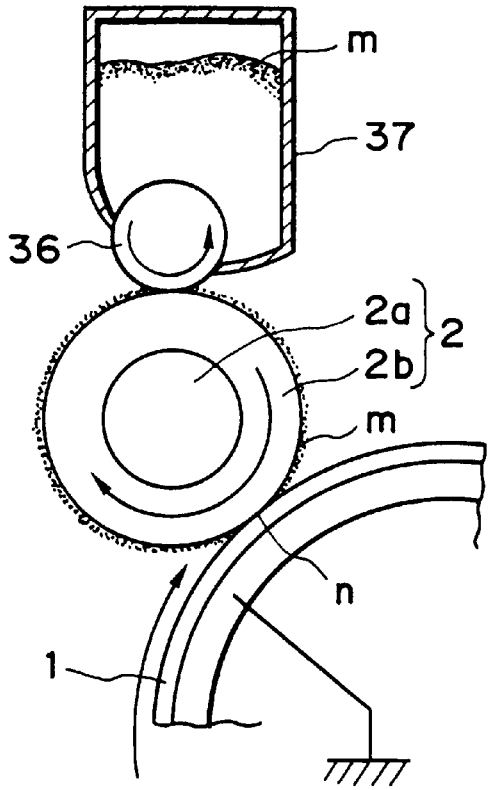
FIG. 5 is a schematic illustration of an image recording device of comparison example 4.

The printer of this comparison example is a printer which is similar to the cleanerless printer of Embodiment 2, but the charge promotion particle supplying means 3 for the charging roller 2 is different and is as shown in FIG. 5.

More particularly, in order to uniformly supply the charge promotion particles m onto the charging roller 2, a charge promotion particle application roller 36 is provided. As the supplying means, the application roller 36 is contacted to the charging roller 2, and the application roller 36 is rotated at a speed of 150% of the charging roller 2 so that charge promotion particle m powder filled in the housing 37 is applied and supplied onto the surface of the charging roller 2.

The other structures are the same as the printer of Embodiment 2.

<Evaluation>

Using the printers of Embodiments 1–3 and comparison examples 1–4, the charging property, scattering of the charge promotion particle and the half-tone density non-uniformity were evaluated. The results are given in Table 1.

a) evaluation of the charging property

The charging property was evaluated on the basis of deterioration of the ghost image.

In the printers of the foregoing embodiments, the image is developed through reverse development, and therefore, the ghost image here means the image of the previous image pattern where the light is projected (toner portion) and where the charging in the next image formation is not sufficient.

The image evaluation was based on the following. After one solid black image is formed, an image is formed and is evaluated.

NG: a ghost pattern is seen in the white background portion after the solid black image formation.

G: No ghost pattern is seen in the white background portion, but a ghost pattern is slightly seen in the half-tone portion, after the solid black image formation.

E: No ghost pattern is seen in the white background portion or the half-tone portion after the solid black image formation.

The evaluation is made at the initial stage of the printing and at 1000 sheets printing (A4 sheets were fed in the longitudinal direction).

The print ratio of the test image pattern was 5% and was constant in the longitudinal direction.

Scattering of the charge promotion particle

The charge promotion particle has so small diameter that they are easily scattered. When a larger, amount of the particles are scattered, they block the optical path for the image exposure, or they may be deposited on a member around the charging roller into masses of particles which may drop on the photosensitive drum and may be a cause of image defect.

After 1000 sheets printing, the particle scattering around the charger is observed.

c) evaluation of the half-tone density non-uniformity

With repeated printing operations, the toner enters the charge portion in accordance with the printing pattern, and therefore, the toner stagnates at the charger corresponding to the pattern, with the possible result of non-uniformity of the recorded image. Particularly, the non-uniformity is remarkable in the half-tone portion.

In these evaluations, an uniform half-tone image data are given to form an image, and the non-uniformity therein is evaluated.

In the image data for the evaluation, black and white are repeated for each line at the image density of 600 dpi and 300 dpi over the entire surface of the recording sheet. The evaluation is made at the initial stage of the printing and at 1000 sheets printing (A4 sheets were fed in the longitudinal direction). The print ratio of the test image pattern was 5% and was not constant in the longitudinal direction.

NG: non-uniformity is seen in the halftone image of 300 dpi.

F: No non-uniformity is seen at 300 dpi, but non-uniformity is seen at 600 dpi.

G: No non-uniformity is seen in the halftone image either at 300 dpi or 600 dpi.

TABLE 1

| | toner recycle | particle scatter around charger | charging property | nonuniformity of half-tone image |
|---|---|---|---|---|
| Emb. 1 bar + clnr | no | small | E | F |
| Emb. 2 bar + no clnr | yes | small | E | F |

TABLE 1-continued

| | toner recycle | particle scatter around charger | charging property | nonuniformity of half-tone image |
|---|---|---|---|---|
| Emb. 3 bar + no clnr + applicator roller | yes | small | E | G |
| Comp. 1 clnr | no | — | N | N |
| Comp. 2 no clnr | yes | — | N | N |
| Comp. 3 pwdr + no clnr applicator blade | yes | large | E | N |
| Comp. 4 pwdr + no clnr applicator roller | yes | large | E | F |

From the results, the following evaluations are made.

(1) in the printer of comparison example 1, the charging property of the charging roller 2 was not maintained properly even with the provision of the cleaner 8 because of the non-supply of the charge promotion particles m to the charging roller 2.

(2) in the printer of comparison example 2, the charging property is further deteriorated because the toner introduction is significant to the charging roller 2 (cleanerless) and because no charge promotion particle m is supplied to the charging roller 2.

(3) in the printer of Embodiment 1, satisfactory charging property is provided because of the supply and application of the charge promotion particles m on the charging roller 2 by the charge promotion particle bar 31.

Furthermore, by the charge promotion particle supply member 31 being swung in the longitudinal direction and being reciprocated with the rotation of the roller 2, the particles could be supplied uniformly, so that charging property was satisfactory.

(4) in the printer of Embodiment 2, the toner is not stagnated at the toner, so that charge promotion particles are properly supplied with simple and easy structure. As a result, the toner recycling is accomplished while maintaining the direct charging with high property.

(5) in the printer of the comparison example 3, charge promotion particle m powder is used, and is supplied and applied to the charging roller 2 by the application blade 35. With this structure, the toner was mixed into the powder with the result that charge promotion particles m were not uniformly applied on the charging roller 2. As a result, the toner was stagnated in the charge promotion powder, and density non-uniformity was produced in the half-tone density image due to charging non-uniformity.

(6) in the printer of comparison example 4 where the charge promotion powder was supplied by way of the application roller 36, improper charging and charging non-uniformity occurred due to the toner mixed into the charge promotion powder in the housing 37 similarly to the case of the printer of comparison example 3.

(7) in the printers of comparison example 3 and 4 where the charge promotion particles m were stocked and were applied to the charging roller 2, the charged particles m were scattered.

(8) in the printers of Embodiments 1 and 2, the scattering of particles is not significant, and the charging property and the half-tone density non-uniformity were good since the charge promotion particle are formed into a solid bar 31.

(9) in the printer of Embodiment 3 where the charge promotion particles were formed into a bar 31, and were supplied and applied to the charging roller 2 by way of the application roller 34 from the bar 31, particle scattering was not seen, and the charging property was good with insignificant half-tone density non-uniformity.

Others

The charging roller 2 (flexible contact charging member) is not limited to a charging roller.

The flexible contact charging member may be in the form of a fur brush, felt or textile in the material and configuration. Or, they may be laminated to provide proper elasticity and/or electroconductivity.

When the charge bias applied to a contact type charging member or the development bias applied to a development sleeve may be in the form of an AC biased DC voltage, wherein the waveform of the alternating voltage is optional; the alternating wave may be in the form of a sine wave, a rectangular wave, at triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

The choice of the means for exposing the surface of an image bearing member to form an electrostatic latent image does not need to be limited to the laser based digital exposing means described in the preceding embodiments. It may be an ordinary analog exposing means, a light emitting element such as a LED, or a combination of a light emitting element such as a fluorescent light and a liquid crystal shutter. In other words, it does not matter as long as it can form an electrostatic latent image correspondent to the optical information of a target image.

The use may be made with a surface charge injection layer in the photosensitive member to control the resistance of the photosensitive member surface.

Figure 6:
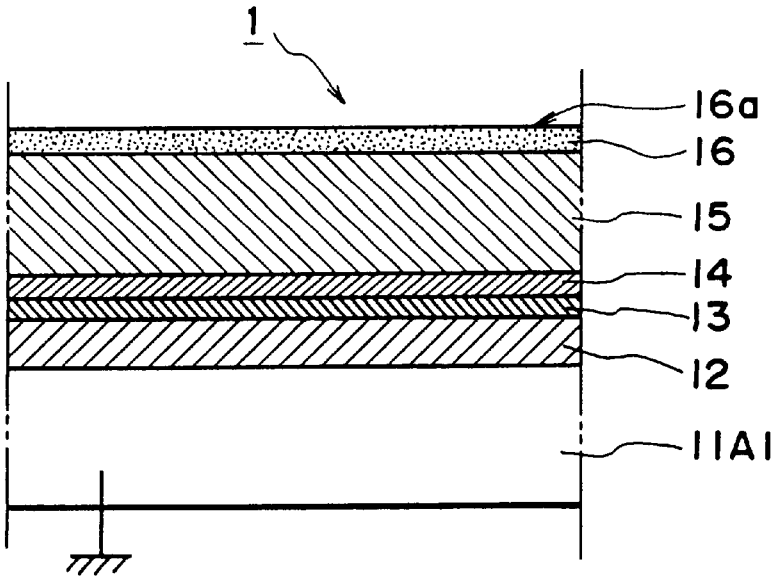
FIG. 6 is a schematic view of the layer structure of an example of a photosensitive member having a charge injection layer on the surface thereof.

FIG. 6 is a schematic view of the layer structure of a photosensitive member 1 having a surface charge injection layer 16. The photosensitive member 1 comprises, as in a known organic photosensitive member, an aluminum drum base (drum bass) 11A1, a liner layer 12 thereon, a positive charge injection preventing layer 13 thereon, a charge generating layer 14 thereon and a charge transfer layer 15, and a charge injection layer 16 is applied on the organic photosensitive member to improve the charging property.

As for the charge injection layer 16, SnO2 ultra-fine particles 16*a*, having a diameter of approximately 0.03 $\mu$m, as electroconductive particles (electroconductive filler), lubricant such as tetrafluoroethylene resin material (tradename of Teflon), polymerization initiator and the like are mixed and dispersed in photo-curing type acrylic resin material as a binder, and the mixture is applied and formed into a film through photo-curing method.

The resistance of the surface layer is important from the standpoint of function of the charge injection layer 16. In the charging system using the direct injection of the charge, the charge is efficiently moved if the resistance of the member to be charged is lowered. On the other hand, from the standpoint of the function of the photosensitive member, it is required to keep the electrostatic latent image for a predetermined period of time, and therefore, the volume resistivity of the charge injection layer 16 is preferably $1\times10^{9}$–$1\times10^{14}$ (Ωcm).

In the case of not using the charge injection layer 16 as in this embodiment, the equivalent effects are provided if the charge transfer layer 15 has the resistance in the above range.

The same advantages are provided when the use is made with an amorphous silicon photosensitive member or the like having a volume resistivity of approximately $10^{13}$ Ωcm.

The image bearing member may be an electrostatic recording dielectric member or the like. In this case, the dielectric member surface is uniformly charged (primary charging) to a predetermined polarity and potential, and thereafter, it is selectively discharged by a discharging stylus head, an electron gun or another discharging means to write an intended electrostatic latent image.

The developing device S used in the foregoing embodiments, is a reverse development device with one component magnetic toner, but the developing device structure is not limited to that. It may be a regular developing device.

The recording material which receives the toner image from the image bearing member may be an intermediary transfer member such as transfer drum or the like.

One example of a method for measuring the size of toner particles is as follows. A measuring apparatus is a Coulter counter TA-2 (product of Coulter Co., Ltd.) To this apparatus, an interface (product of NIPPON KAGAKU SEIKI) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 microns in particle size is measured with the use of the aforementioned Coulter counter TA-2, the aperture of which is set at 100 microns, and the volumetric average distribution of the toner particles is obtained. Finally, the volumetric average particle size of the toner particles is calculated from the thus obtained volumetric average distribution of the toner particles.

As regards the structure for providing the speed difference, the contact charging member is structured so as to provide the speed difference. It is possible to provide the speed difference by moving the contact charging member in the same direction as the movement direction of the surface of the member to be charged in the nip. Since, however, the charging property of the injection charging relies on the peripheral speed ratio of the peripheral speed of the member to be charged and the peripheral speed of the contact charging member, the rotational frequency of the contact charging member is larger in the codirectional peripheral movement than in the counterdirectional movement to provide the same peripheral speed ratio. Therefore, the arrangement to provide the counterdirectional peripheral movement is preferable.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a charging member to which a voltage is applicable to charge a member to be charged, said charging member forming a nip with the member to be charged; and an electroconductive particle supply member for supplying electroconductive particles, wherein said supply member produces the electroconductive particles by abrasion of itself, and the thus produced electroconductive particles are fed to said nip.

2. A charging apparatus according to claim 1, wherein said supply member is contactable to said charging member.

3. A charging apparatus according to claim 1, wherein said electroconductive particle supply member is contactable to said charging member, and further comprises an electroconductive particle applying member for applying the electroconductive particles to said charging member, and wherein said supply member is contactable to the electroconductive particle applying member.

4. A charging apparatus according to claim 1, wherein said charging member is driven so as to provide speed difference between a surface of said charging member and a surface of said member to be charged in said nip.

5. A charging apparatus according to claim 1, wherein the volume resistivity of said electroconductive particles is not more than $10^{12}$ Ωcm.

6. A charging apparatus according to claim 1, wherein volume resistivity of said electroconductive particle is not more than $10^{10}$ Ωcm.

7. A charging apparatus according to claim 1, wherein said electroconductive particles are non-magnetic.

8. A charging apparatus according to claim 1, wherein a particle size of the electroconductive particles is not more than 50 μm.

9. A charging apparatus according to claim 1, wherein said charging member includes a flexible member.

10. A charging apparatus according to claim 9, wherein said flexible member is of foam material.

11. A charging apparatus according to claim 4, wherein a movement direction of a surface of said member to be charged and a movement direction of a surface of said charging member are opposite from each other in the nip.

12. A charging apparatus according to any one of claims 1–11, wherein said charging member effects injection charging into said member to be charged in said nip.

13. An image forming apparatus comprising:

a member to be charged;

an image forming means for forming a toner image on said member to be charged, said image forming means including a charging member to which a voltage is applicable to charge said member to be charged, and said charging member including a flexible member for forming a nip with said member to be charged;

an electroconductive particle supply member for supplying electroconductive particles;

wherein said supply member produces the electroconductive particles by abrasion of itself, and the thus produced electroconductive particles are fed to said nip.

14. An image forming apparatus according to claim 13, wherein said supply member is contactable to said charging member.

15. An image forming apparatus according to claim 13, further comprises an electroconductive particle applying member which is contactable to said charging member and for applying the electroconductive particles to said charging member, and wherein said supply member is contactable to the electroconductive particle applying member.

16. An image forming apparatus according to claim 13, wherein said flexible member is driven so as to provide a speed difference between a surface of said flexible member and a surface of said member to be charged in said nip.

17. An image forming apparatus according to claim 13, wherein a volume resistivity of said electroconductive particle is not more than $10^{12}$ Ωcm.

18. An image forming apparatus according to claim 13, wherein the volume resistivity of said electroconductive particles is not more than $10^{12}$ Ωcm.

19. An image forming apparatus according to claim 13, wherein said electroconductive particles are non-magnetic.

20. An image forming apparatus according to claim 13, wherein a particle size of the electroconductive particles is not more than 50 μm.

21. An image forming apparatus according to claim 13, wherein said flexible member is elastic.

22. An image forming apparatus according to claim 13, wherein said flexible member is of foam material.

23. An image forming apparatus according to claim 16, wherein a movement direction of a surface of said member to be charged and a movement direction of a surface of said flexible member are opposite from each other in the flip.

24. An image forming apparatus according to any one of claims 13–23, wherein said charging member effects injection charging into said member to be charged in said nip.

25. An image forming apparatus according to claim 13, wherein said member to be charged is provided with a surface layer having a volume resistivity of not more than $1\times10^{14}$ Ωcm.

26. An image forming apparatus according to claim 25, wherein the volume resistivity is not less than $1\times10^{9}$ Ωcm.

27. An image forming apparatus according to claim 26, wherein said member to be charged is provided with an electrophotographic photosensitive layer beneath said surface layer.

28. An image forming apparatus according to claim 13, wherein said image forming means includes developing means for developing an electrostatic latent image formed on said member to be charged with toner, and said developing means is capable of removing residual toner from said member to be charged.

29. An image forming apparatus according to claim 28, wherein said developing means is capable of removing the residual toner from said member to be charged simultaneously with developing the latent image.

* * * * *

UNITED STATES PATENT AND TRADEMARK OFFICE

CERTIFICATE OF CORRECTION

PATENT NO. : 6,038,418
DATED : March 14, 2000
INVENTOR(S) : Yasunori Chigono et al.

Figure 7:
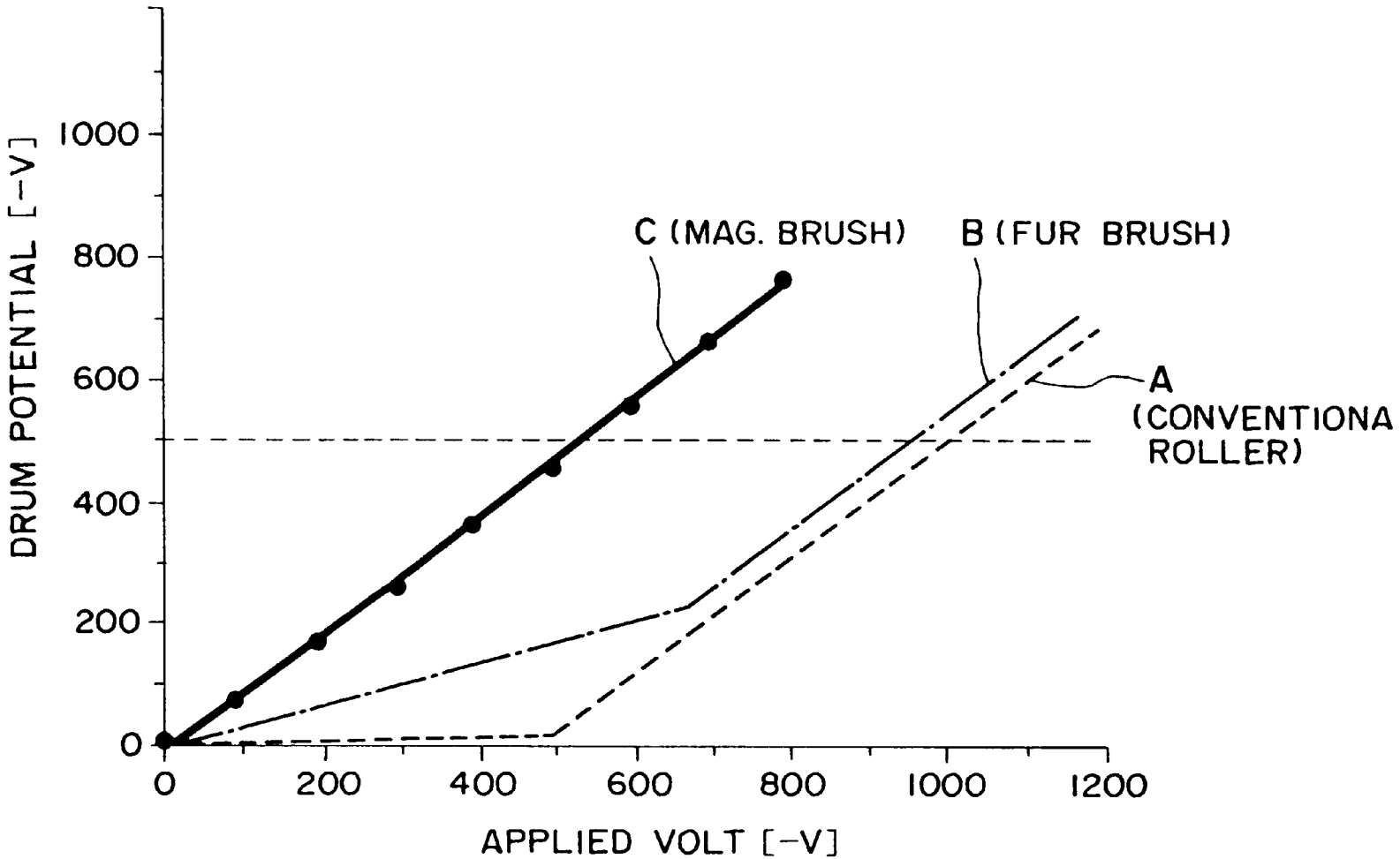
FIG. 7 is a graph of a charging property.

It is certified that error appears in the above-identified patent and that said Letters Patent is hereby corrected as shown below:

Drawings,
Figure 7, "(CONVENTIONA" should read -- (CONVENTIONAL --.

Column 1,
Line 11, "includes" should read -- include --;
Line 21, "(electrostatic" should read -- electrostatic --; and
Line 61, "principle.) :" should read -- principle) : -- .

Column 3,
Line 20, "correspondent" should read -- corresponding --; and
Line 64, "counter measure" should read -- countermeasure --.

Column 4,
Line 47, "pile," should read -- a pile, --.

Column 6,
Line 29, "brush" should read -- for brush --; and
Line 30, "uantransferred" should read -- untransferred --.

Column 7,
Line 65, "the" should be deleted.

Column 9,
Line 29, "(surface" should read -- surface --;
Line 39, "an" should read -- a --; and
Line 40, "toner (negative" should read -- toner (negative --.

Column 10,
Line 66, "an" should read -- a --.

Column 11,
Line 32, "Means" should read -- Means 3 --.

Column 13,
Line 8, "charging(injection" should read -- charging (injection --; and
Line 11, "device(or) should read -- device (or --; and
Line 21, "toner(insulative) should read -- toner (insulative --.

Column 14,
Line 34, "$5x10^5/m^2$" should read -- $5x10^5/mm^2$ --.

UNITED STATES PATENT AND TRADEMARK OFFICE

CERTIFICATE OF CORRECTION

PATENT NO. : 6,038,418
DATED : March 14, 2000
INVENTOR(S) : Yasunori Chigono et al.

It is certified that error appears in the above-identified patent and that said Letters Patent is hereby corrected as shown below:

Column 15,
Line 54, "pf" should read -- of --; and
Line 64, "particle" should read -- particles --.

Column 16,
Line 16, "is" should read -- are --;
Line 29, "supply" should read -- supplying --;
Line 40, "roller(charge" should read -- roller (charge --;
Line 43, "member(charge" should read -- member (charge --;
Line 52, "an d" should read -- and --; and
Line 54, "clockwis e" should read -- clockwise --.

Column 18,
Line 39, "an" should read -- a --; and
Table 1, "nonuni-" should read -- non-uni --.

Column 19,
Table 1, "nonuni-" should read -- non-uni --; and
Line 62, "example" should read -- examples --.

Column 20,
Line 30, "the · laser" should read -- the laser --;
Line 36, "correspondent" should read -- corresponding --; and
Line 50, "$S_nO2$" should read -- $S_nO_2$ --

Column 21,
Line 15, "device S" should read -- device 5 --.

UNITED STATES PATENT AND TRADEMARK OFFICE

CERTIFICATE OF CORRECTION

PATENT NO. : 6,038,418
DATED : March 14, 2000
INVENTOR(S) : Yasunori Chigono et al.

It is certified that error appears in the above-identified patent and that said Letters Patent is hereby corrected as shown below:

Column 22,
Line 52, "charged;" should read -- charged; and --; and
Line 54, "particles;" should read -- particles, --.

Signed and Sealed this

Twenty-fifth Day of December, 2001

*Attest:*

*Attesting Officer*

JAMES E. ROGAN
*Director of the United States Patent and Trademark Office*